US012139307B2

(12) United States Patent
Murphy

(10) Patent No.: US 12,139,307 B2
(45) Date of Patent: Nov. 12, 2024

(54) CONTAINER COMPRISING A DUCKBILL VALVE AND A LEAK-RESISTANT CLOSURE MECHANISM

(71) Applicant: RLM GROUP LTD., Mt. Kisco, NY (US)

(72) Inventor: Robert L. Murphy, Mt. Kisco, NY (US)

(73) Assignee: RLM GROUP LTD., Mt. Kisco, NY (US)

( * ) Notice: Subject to any disclaimer, the term of this patent is extended or adjusted under 35 U.S.C. 154(b) by 0 days.

(21) Appl. No.: 17/755,285

(22) PCT Filed: Mar. 12, 2021

(86) PCT No.: PCT/US2021/022088

§ 371 (c)(1),
(2) Date: Apr. 26, 2022

(87) PCT Pub. No.: WO2021/183872

PCT Pub. Date: Sep. 16, 2021

(65) Prior Publication Data

US 2022/0380096 A1 Dec. 1, 2022

Related U.S. Application Data

(60) Provisional application No. 62/988,566, filed on Mar. 12, 2020.

(51) Int. Cl.
*B65D 47/20* (2006.01)
*A45D 34/04* (2006.01)
(Continued)

(52) U.S. Cl.
CPC ..... *B65D 47/2031* (2013.01); *A45D 34/04* (2013.01); *A45D 40/26* (2013.01);
(Continued)

(58) Field of Classification Search
CPC ..... B65D 47/2031; B65D 47/122; B65D 51/165; B65D 1/32; A45D 34/04; A45D 40/26
(Continued)

(56) References Cited

U.S. PATENT DOCUMENTS 2,758,755 A 8/1956 Schafler
5,213,236 A * 5/1993 Brown ..... B65D 47/2031 220/203.18
(Continued)

FOREIGN PATENT DOCUMENTS

WO 2010/080897 A1 7/2010
WO 2015/197599 A1 12/2015
(Continued)

OTHER PUBLICATIONS

International Search Report and Written Opinion of the International Searching Authority for International Application No. PCT/US2021/022088 mailed Jun. 22, 2021.

*Primary Examiner* — Charles P. Cheyney
(74) *Attorney, Agent, or Firm* — K&L Gates LLP

(57) ABSTRACT

A container that stores and dispenses a fluid agent container comprises a flexible body portion, a duckbill valve, and a cap. The flexible body portion defines an internal cavity; the internal cavity is configured to store the fluid agent therein; and an opening is defined in the body portion. The duckbill valve is coupled to the opening of the body portion, with the duckbill valve being configurable between an open configuration and a closed configuration such that the duckbill valve prevents the flow of the fluid agent out of the internal cavity when the duckbill valve is in the closed configuration and permits the flow of the fluid agent out of the internal cavity when the duckbill valve is in the open configuration. The
(Continued)

duckbill valve is prevented from being motivated into the open configuration when the cap is coupled to the body portion.

14 Claims, 5 Drawing Sheets

(51) Int. Cl.
*A45D 40/26* (2006.01)
*B65D 47/12* (2006.01)

(52) U.S. Cl.
CPC ..... *B65D 47/122* (2013.01); *A45D 2200/051* (2013.01); *B65D 2251/20* (2013.01); *B65D 2547/063* (2013.01)

(58) Field of Classification Search
USPC ..... 222/490–496, 92, 106, 107, 212, 213
See application file for complete search history.

(56) References Cited

U.S. PATENT DOCUMENTS 5,320,254 A * 6/1994 Ranalletta ..... B05B 11/047 222/189.09
5,390,805 A * 2/1995 Bilani ..... B65D 47/0838 137/845
5,431,310 A * 7/1995 Kanner ..... B05B 11/007 222/212
5,944,234 A * 8/1999 Lampe ..... B65D 47/0804 222/545
6,062,436 A * 5/2000 Fuchs ..... B65D 47/2031 137/846
6,457,613 B1 10/2002 Patterson
6,672,479 B2 * 1/2004 Shiraishi ..... B65D 47/2031 222/215
8,413,857 B2 4/2013 Johnson
9,718,070 B2 8/2017 Arminak et al.
9,930,954 B2 * 4/2018 Smith ..... A45D 40/26
2008/0061089 A1 3/2008 Wellman
2008/0110938 A1 5/2008 Sternberg
2019/0208889 A1 7/2019 Murphy et al.
2019/0218001 A1 * 7/2019 Vredevoogd ..... B65D 47/0804

FOREIGN PATENT DOCUMENTS

WO 2021/002879 A1 1/2021
WO 2021/190883 A1 9/2021

* cited by examiner 138
130
136
120
110
136
138
110
136
138
120
100
110

CONTAINER COMPRISING A DUCKBILL VALVE AND A LEAK-RESISTANT CLOSURE MECHANISM

CROSS-REFERENCE TO RELATED APPLICATION

The present application is a national stage application under 35 U.S.C. § 371 of PCT Application No. PCT/US2021/022088, which claims priority to U.S. Provisional Patent Application Ser. No. 62/988,566, filed Mar. 12, 2020, having the same title and inventor as indicated above, and which is incorporated herein by reference in its entirety.

BACKGROUND

Fluid products, such as viscous and/or thin cosmetics or dermatological agents, are often packaged in containers comprising flexible walls for storage and distribution. Even with an appropriately affixed cap, the contents of such containers are susceptible to leaking in response to external forces acting on the flexible walls. Leakage of the fluid contents can result in a build-up of product on a dispensing orifice as a user oftentimes fails to clean the dispensing orifice prior to sealing the container due to inconvenience and/or impracticality, for example. The built-up residue on the dispensing orifice can result in a messy, non-visually appealing, contaminated, and/or non-functional dispensing orifice.

It is often difficult to dispense a uniform, or pre-determined, amount of product with a standard flexible container (e.g., a tube) as the flexible nature of the container makes it difficult to moderate product flow. Product can continue to flow out of a standard container after pressure compressing the container walls is released and the flexible container collapses from atmospheric pressure.

In various instances, duckbill valves are utilized to dispense product from such flexible containers. With existing container closure technology, it is difficult to seal a protruding duckbill valve due, at least in part, to the asymmetrical shape of the duckbill. In such instances, a slit of the duckbill valve opens when a force is applied to the flexible container. Product thereby leaks out of the dispensing orifice even when existing caps are appropriately attached to the container.

Standard containers comprise a body portion and a cap that are configured to be threadably coupled to one another. The threadable engagement between existing cap and the body portions prevent utilizing an asymmetrical socket within the cap to fully encapsulate the asymmetrical shape of the duckbill as manufacturers and/or users are unable to orient the two parts together in an accurate manner.

SUMMARY

In one general aspect, the present disclosure is directed to a container for storing and dispensing a fluid agent. The container comprises a flexible body portion, a duckbill valve, and a cap. The flexible body portion defines an internal cavity that is configured to store the fluid agent therein, and where the body portion defines an opening. The duckbill valve is coupled to the opening of the body portion, and the duckbill valve is configurable between an open configuration and a closed configuration such the duckbill valve prevents the flow of the fluid agent out of the internal cavity when the duckbill valve is in the closed configuration and permits the flow of the fluid agent out of the internal cavity when the duckbill valve is in the open configuration. The duckbill valve is prevented from being motivated into the open configuration when the cap is coupled to the body portion.

In another general aspect, the present disclosure is directed to a packaging that comprises a bottle and a cap. The bottle defines an internal reservoir that is configured to store a viscous agent. At least a portion of the bottle is comprised of a pliable material. An opening is defined in the bottle to dispense the viscous agent therethrough. The viscous agent is prevented from being dispensed out of the opening when the cap is coupled to the bottle.

In another general aspect, the present disclosure is directed to a container for storing and dispensing a fluid. The container comprises a body portion defining an internal reservoir, a duckbill valve, and a cap. The internal reservoir defined by the body portion is configured to store the fluid therein, where at least a portion of the body portion is flexible. An opening is defined in the body portion and the duckbill valve is coupled to the body portion through the opening. The cap comprises an exterior wall and an interior wall. The interior wall defines a chamber configured to closely surround the duckbill valve when the cap is coupled to the body portion. The fluid is prevented from dispensing out of the duckbill valve when the interior wall of the cap closely surrounds the duckbill valve.

FIGURE DESCRIPTIONS

Various features of the exemplary embodiments described herein, together with advantages thereof, may be understood in accordance with the following description taken in conjunction with the accompanying drawings as follows.

Corresponding reference characters indicate corresponding parts throughout the several views. The exemplifications set out herein illustrate various embodiments of the invention, in one form, and such exemplifications are not to be construed as limiting the scope of the invention in any manner.

DESCRIPTION

Figure 1:
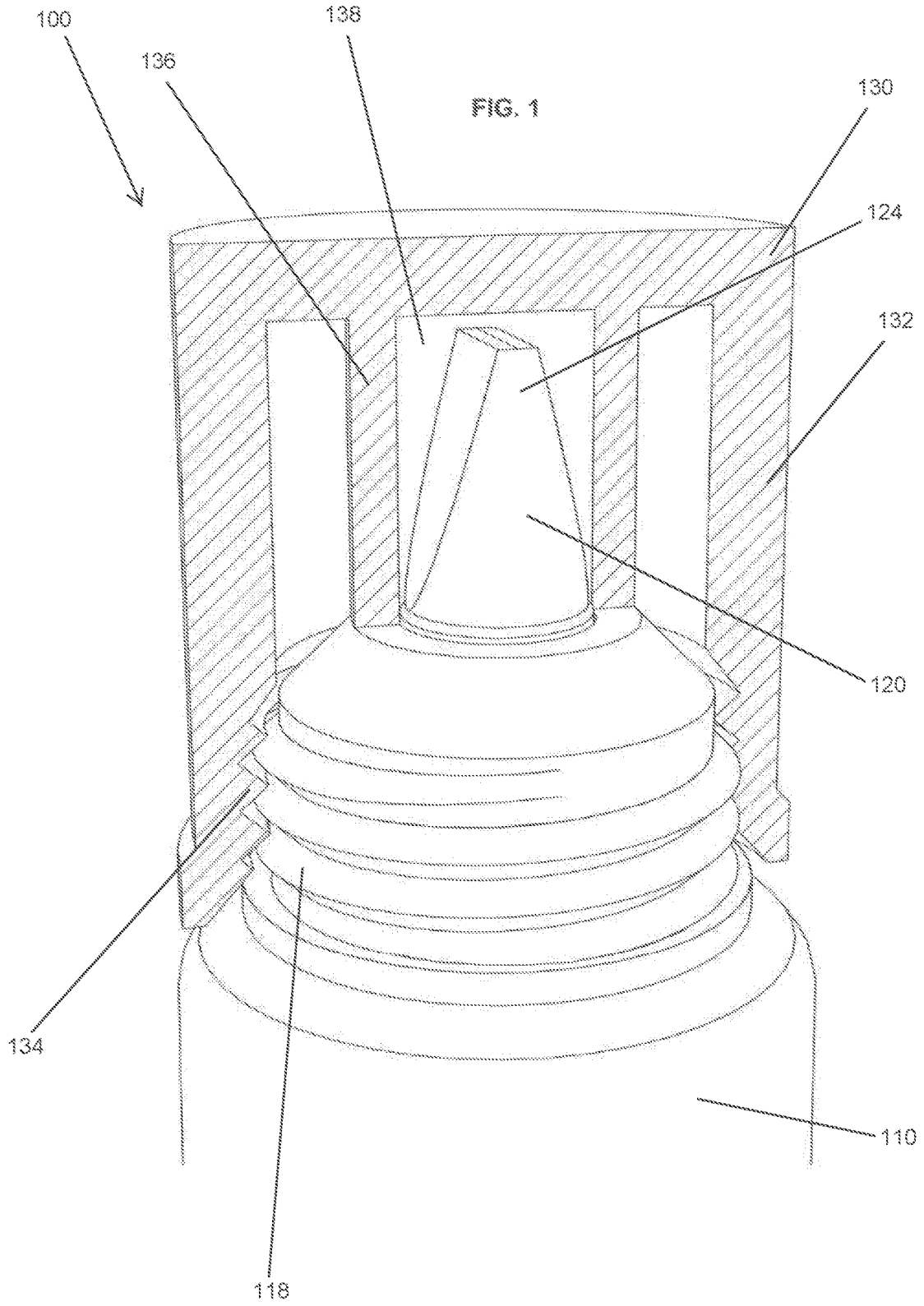
FIG. 1 is a partial cross-sectional view of a container comprising a body portion, a duckbill valve, and a cap in accordance with at least one aspect of the present disclosure.
Figures 2A, 2B, 2C:
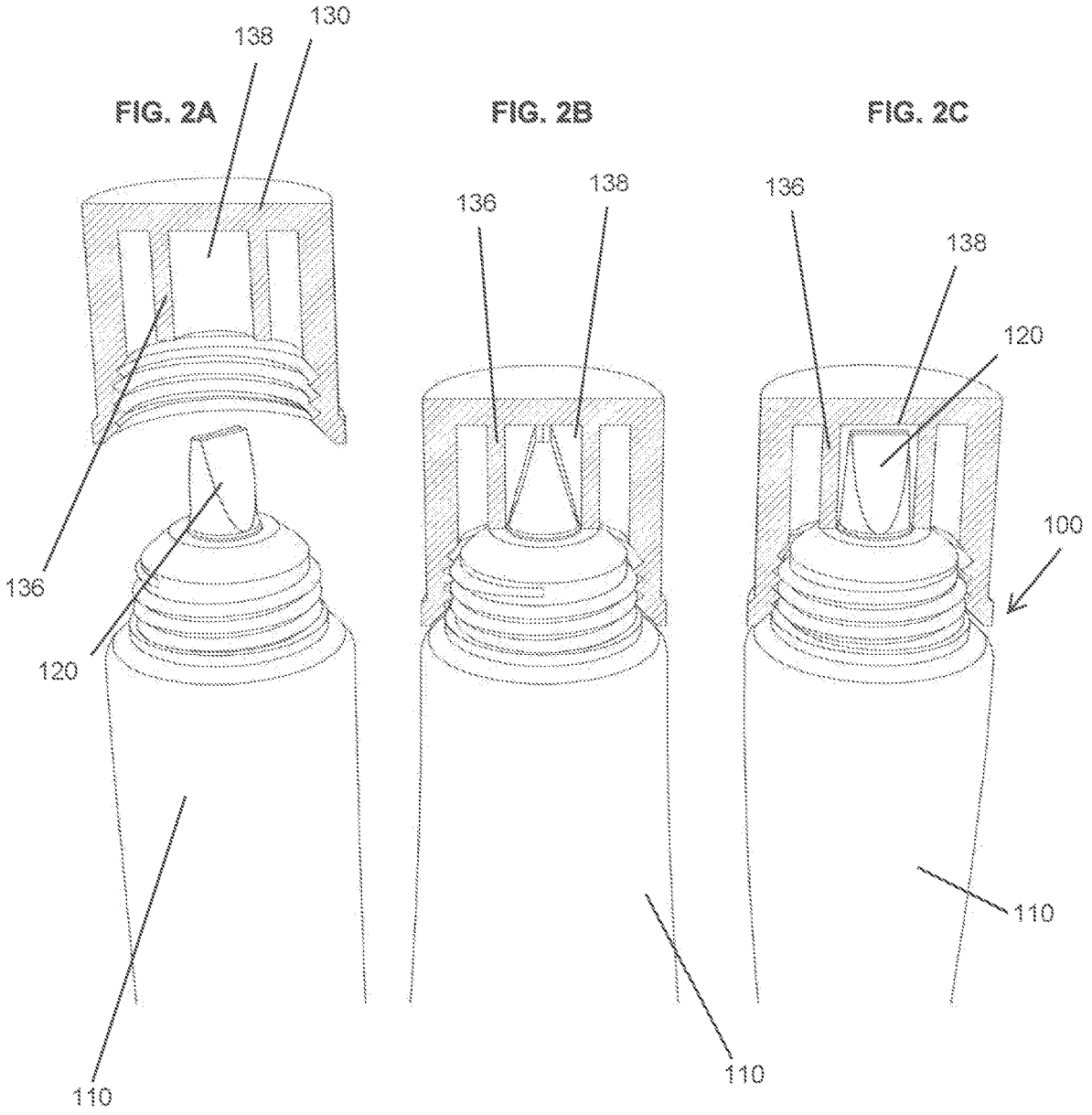
FIG. 2A is a partial cross-sectional view of the container of FIG. 1 prior to the cap being attached to the body portion in accordance with at least one aspect of the present disclosure.
FIG. 2B is a partial cross-sectional view of the container of FIG. 1 illustrating a headspace defined when the cap is attached to the body portion in accordance with at least one aspect of the present disclosure.
FIG. 2C is a partial cross-sectional view of the container of FIG. 1 illustrating a headspace defined when the cap is attached to the body portion in accordance with at least one aspect of the present disclosure.

FIGS. 1, 2A-C and 3 illustrate a container 100 comprising a body portion 110, a duckbill valve 120, and a cap 130. The body portion 110 defines an internal reservoir, or cavity 112, wherein the internal reservoir 112 is configured to store a fluid agent therein. In various instances, the body portion 110 comprises a squeezable tube; however, other suitable container-type body portions are envisioned. Exemplary fluid agents include cosmetic and/or dermatological fluids, creams, oils, and/or serums; however any substance capable of flowing is envisioned for use with the containers disclosed herein. The container 100 is configured to dispense the fluid agent in the body portion 110 via the duckbill valve, or applicator, 120, although other suitable dispensing mechanisms are envisioned.

Figure 3:
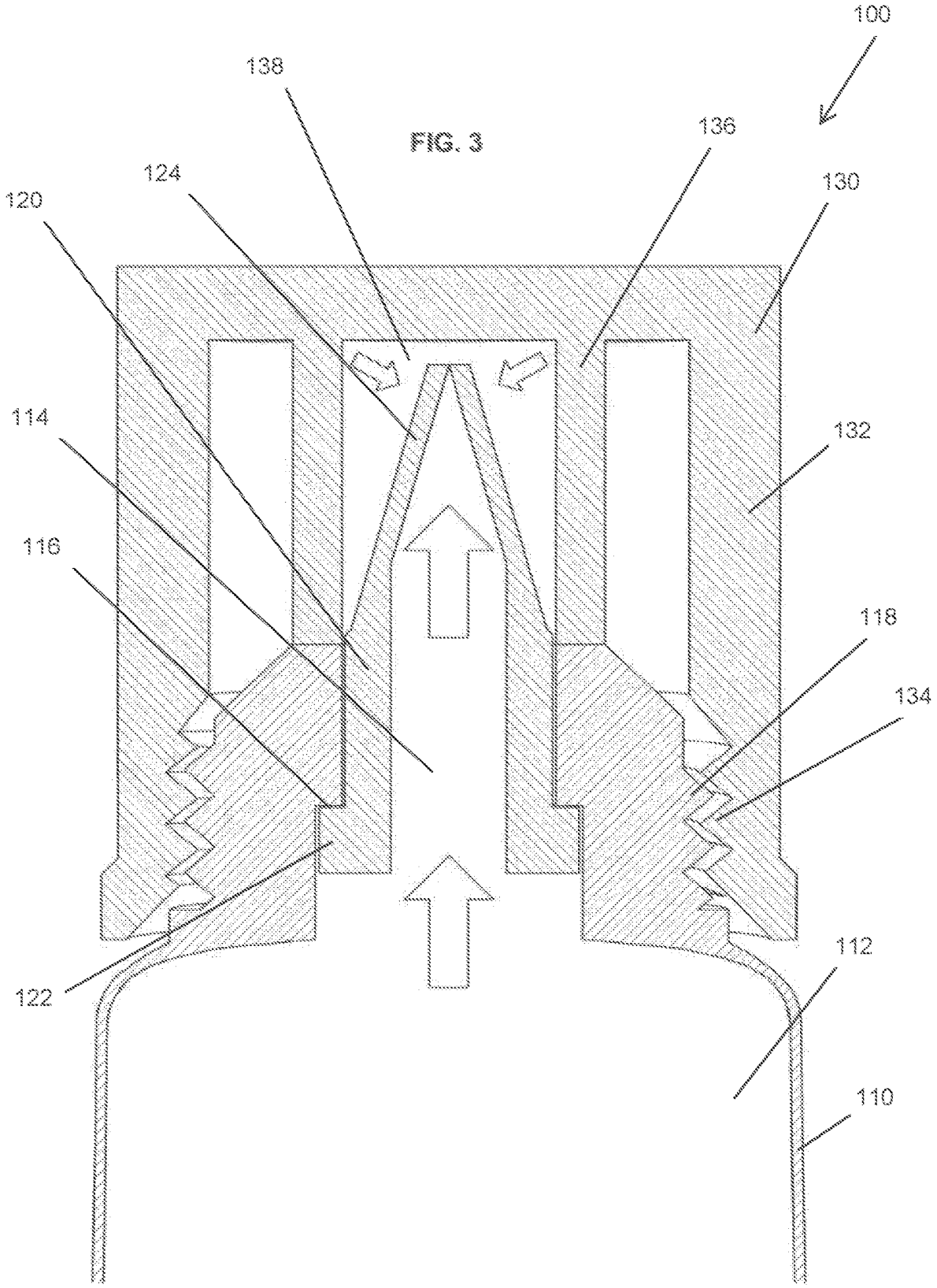
FIG. 3 is a partial cross-sectional view of the container of FIG. 1 illustrating a relationship between a chamber of the cap and the duckbill valve when the cap is coupled to the body portion in accordance with at least one aspect of the present disclosure.

As shown in FIG. 3, an opening (or exit channel) 114 is defined in the body portion 110. In the absence of the duckbill valve 120, the fluid agent contained in the internal reservoir 112 is able to flow out of the body portion 110 through the opening 114. The duckbill valve 120 is configured to be coupled to the body portion 110 through the opening 114, as described in greater detail herein. The duckbill valve 120 is sized to be closely received within the opening 114 of the body portion 110 in a manner that prevents and/or prohibits the fluid agent from bypassing the duckbill valve 120 when flowing out of the body portion 110. Stated another way, the fluid agent can only flow out of the body portion 110 through the duckbill valve 120.

The duckbill valve 120 is configured to be replaceably attached to the body portion 110. In various instances, an elastomer duckbill valve protrudes from the body portion 110. The flexible nature of the duckbill valve 120 encourages wiping of the dispensing orifice 124. As shown in FIG. 3, the duckbill valve 120 comprises a shelf 122 that forms an interface with a ledge 116 defined on the body portion 110. The interface between the shelf 122 of the duckbill valve 120 and the ledge 116 of the body portion 110 creates a seal and/or fluid-tight barrier that prevents and/or prohibits the fluid agent from leaking out of the body portion 110. In other instances the duckbill valve 120 is integrally formed with the body portion 110.

At least a portion of the body portion 110 is comprised of a flexible, elastic, and/or resilient material, such as plastic, thermoplastic polymer, polyethylene (e.g., high-density polyethylene, HDPE), etc. In various instances, a wall of the body portion 110 surrounding the opening 114 is thicker than the wall of the body portion 110 surrounding the internal reservoir 112. In such instances, the body portion 110 can be less flexible and/or more rigid at the opening 114 than at the internal reservoir 112. Such rigidity can provide increased stability near the dispensing mechanism, for example. The flexible characteristics of the body portion 110 operate in conjunction with the duckbill valve 120 to provide a vacuum effect that minimizes residual fluid contents from continuing to flow out of the body portion 110 after a desired amount of the fluid contents has been dispensed.

The duckbill valve 120 is configurable in an open configuration and a closed configuration. The duckbill valve 120 is in the closed configuration until a sufficient force is applied to the body portion 110 of the container 100. The application of a sufficient external force causes air and/or fluid contents stored within the body portion 110 to travel toward the opening 114 thereby causing the duckbill valve 120 to transition into its open configuration. The external force is deemed sufficient when its magnitude exceeds a pre-determined magnitude set, at least in part, by the size of the duckbill valve 120, the material composition of the duckbill valve 120, and/or the material composition of the body portion 110.

In various instances, the duckbill valve 120 is configured to dispense a pre-determined about of fluid agent stored in the body portion 110 when the duckbill valve 120 is in the open configuration. The duckbill valve 120 allows a user to dispense precise amounts of a fluid formula. In various instances, the duckbill valve 120 is configurable in various open configurations. In such instances, a degree that the duckbill valve 120 is open is determined based, at least in part, on the magnitude of the force applied to the body portion 110. Varying amounts of the fluid agent are then dispensed out of the duckbill valve 120 relative to the degree that the duckbill valve 120 is open. Additionally, the amount of fluid agent dispensed per activation/application can depend on the viscosity of the fluid, the size of the duckbill valve 120, the force applied to the body portion 110, and/or a durometer, for example.

In various instances, the duckbill valve 120 is configured to dispense an amount of the fluid agent without backflow. In such instances, air is prevented from entering the internal reservoir 112 of the body portion 110 after a desired amount of fluid agent is dispensed out of the body portion 110. A lack of air intake can provide a visual indicator to a user of the amount of fluid agent remaining in the body portion 110, for example. The lack of air intake can also prevent contamination of the fluid agent stored within the body portion, for example. The automatic shut-off nature of the duckbill valve 120 prevents over-dispensing as the produce does not continue to flow out of the body portion 110 after the force, or pressure, acting on the body portion 110 is released. The automatic shut-off action also prevents the build-up of residual and/or excess product on the dispensing orifice 124 after attaching the cap 130 numerous times without wiping and/or cleansing the dispensing orifice 124.

In other instances, such as shown in FIGS. 5A-5G, a duckbill valve 520 can dispense an amount of the fluid agent without backflow while also allowing for air to flow back into the body portion 110 after a desired amount of fluid agent is dispensed. Allowing air to flow back into the body portion 110 may allow the body portion 110 to appear more visually appealing, for example.

As shown in FIGS. 1, 2A-C and 3, the cap 130 comprises an exterior wall 132 to facilitate attachment of the cap 130 to the body portion 110. In various instances, the cap 130 is configured to threadably engage at least a portion of the body portion 110. In such instances, the exterior wall 132 comprises a plurality of threads 134 defined thereon and the body portion 110 comprises complementary threads 118 defined thereon to facilitate a secure attachment of the cap 130 to the body portion 110. In other instances, the exterior wall 132 is configured to facilitate a press-fit attachment of the cap 130 to the body portion 110. Alternative attachment mechanisms between the cap 130 and the body portion 110 are also envisioned.

The cap 130 further comprises an interior wall 136. When the cap 130 is coupled to the body portion 110, a seal is formed between a base of the interior wall 136 and a portion of the body portion 110. The interior wall 136 defines a chamber 138 configured to closely surround the duckbill valve 120 when the cap 130 is coupled to the body portion 110. Notably, while the interior wall 136 closely surrounds the duckbill valve 120, the interior wall 136 does not contact a dispensing orifice 124 of the duckbill valve 120. In various instances, the cap 130 does not contact the duckbill valve 120. The chamber 138 is defined by the space presented between the interior wall 136 of the cap 130 and the duckbill valve 120.

As shown in FIGS. 1, 2A-C and 3, the interior wall 136 defines a chamber 138 comprising a symmetrical cylindrical geometry. The chamber 138 comprises a size and a geometry that provides for the duckbill valve 120 to be enclosed in a minimal chamber 138 while also allowing for manageable manufacturing and/or easy recapping by the user, for example. In various instances, the geometry of the chamber 138 closely mimics a geometry of the duckbill valve 120. In various instances, the chamber 138 is defined by tapered walls.

The presence of the sealed chamber 138 prevents air and/or product from flowing and/or leaking out of the duckbill valve 120 and into the cap 130 when the cap 130 is coupled to the body portion 110. Fluid contents of the body portion 110 are prevented from dispensing out of the duckbill valve 120 when the interior wall 134 of the cap 130 closely surrounds the duckbill valve 120. Stated another way, the duckbill valve 120 is prevented from being motivated into the open configuration when the cap 130 is coupled to the body portion 110 due, at least in part, to the sealed chamber 138 formed between the interior wall 136 of the cap 130 and the body portion 110, the size of the chamber 138, and/or the geometry of the chamber 138. Referring primarily to FIG. 3, the presence of the internal chamber 138 defined by the internal wall 136 requires a much larger force to be applied to the body portion 110 in order to motivate the duckbill valve 120 into the open configuration than if the chamber was defined by the exterior wall 132 as in conventional caps. Stated another way, in order for the duckbill valve 120 to compress the trapped air within the minimally-sized chamber 138 by motivating into the open configuration, the body portion 110 must experience a larger force than if the chamber, and thus the trapped air volume, was larger. Furthermore, should any product be able to leak from the duckbill 120, the minimally-sized chamber 138 allows for the volume of the inadvertently dispensed product to be smaller than if the chamber was defined by the exterior wall 132, for example.

Figure 4:
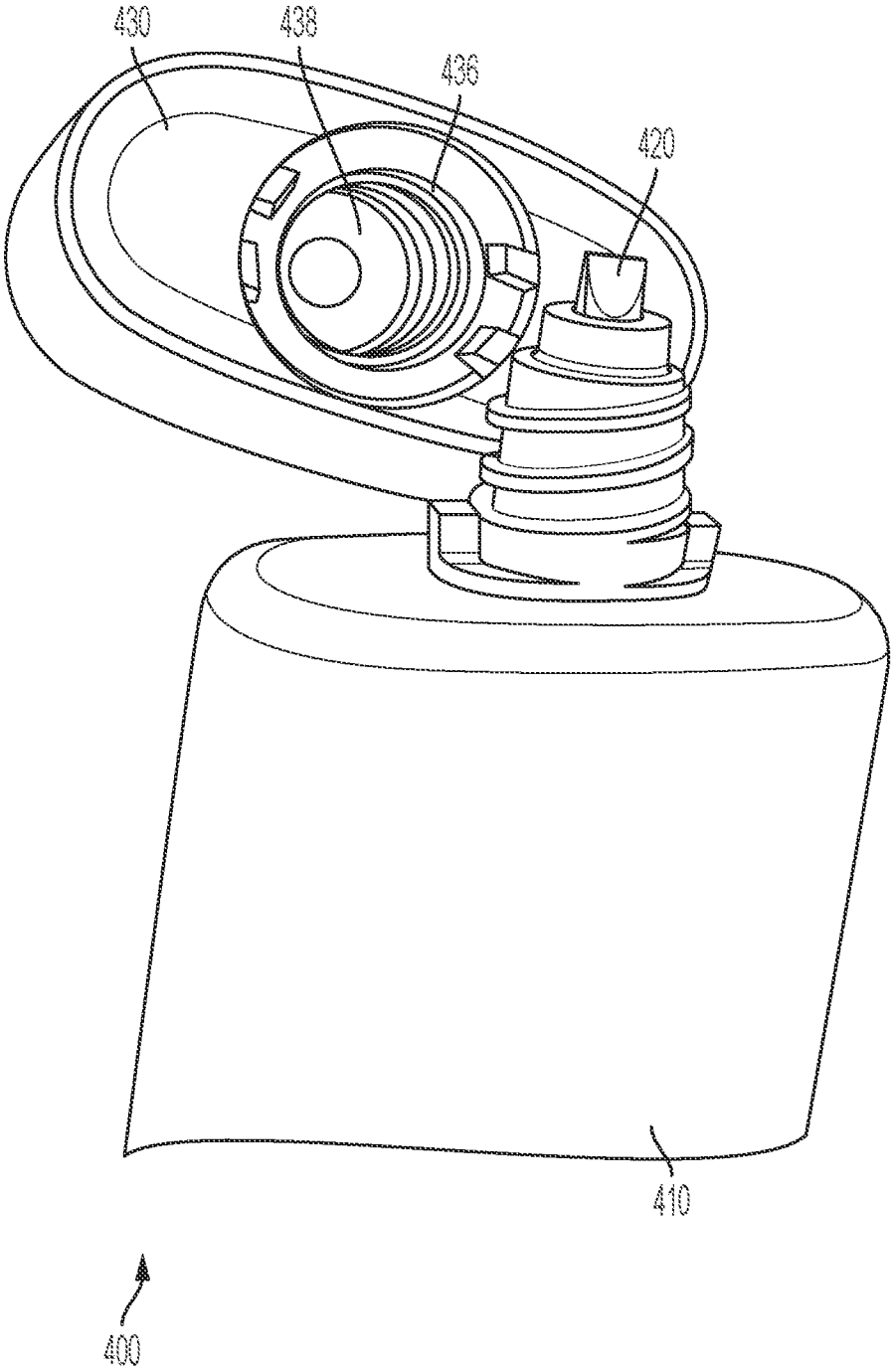
FIG. 4 is a perspective view of a prototype of a container comprising a flexible body portion, a duckbill valve, and a cap in accordance with at least one aspect of the present disclosure.
Figure 5A:
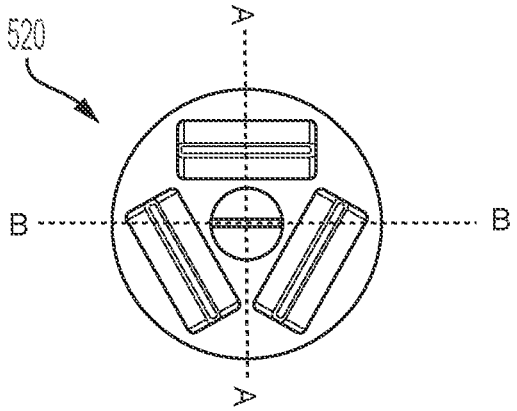
FIG. 5A is a plan view of an alternative embodiment of a duckbill valve in accordance with at least one aspect of the present disclosure.
Figure 5B:
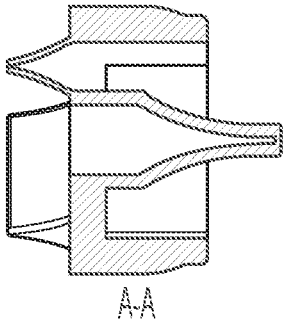
FIG. 5B is a cross-sectional elevational view of the duckbill valve of FIG. 5A in accordance with at least one aspect of the present disclosure.
Figure 5C:
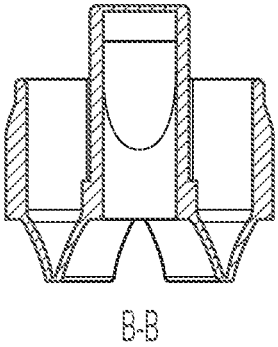
FIG. 5C is a cross-sectional elevational view of the duckbill valve of FIG. 5A in accordance with at least one aspect of the present disclosure.
Figure 5D:
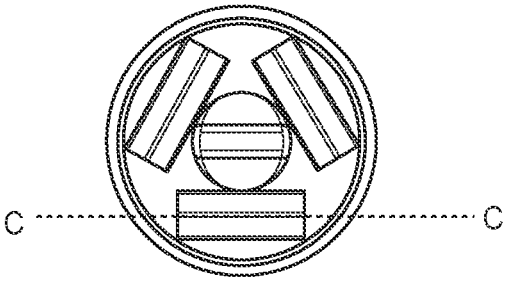
FIG. 5D is a plan view of the duckbill valve of FIG. 5A in accordance with at least one aspect of the present disclosure.
Figure 5E:
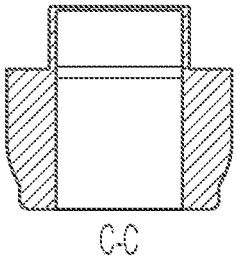
FIG. 5E is a partial cross-sectional view of the duckbill valve of FIG. 5A in accordance with at least one aspect of the present disclosure.
Figure 5F:
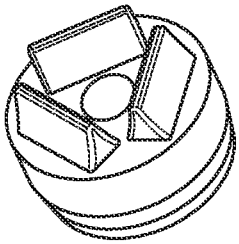
FIG. 5F is a perspective view of the duckbill valve of FIG. 5A in accordance with at least one aspect of the present disclosure.
Figure 5G:
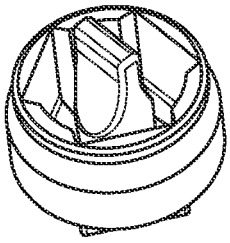
FIG. 5G is a perspective view of the duckbill valve of FIG. 5A in accordance with at least one aspect of the present disclosure.

A prototype of a container 400 comprising a body portion 410, a duckbill valve 420, and a cap 430 is shown in FIG. 4. As discussed in greater detail herein, the cap 430 comprises an interior wall 436 defining a chamber 438 configured to closely encapsulate the duckbill valve 420 when the cap 430 is attached to the body portion 410. The size and/or the geometry of the chamber 438 prevents the duckbill valve 420 from being in the open configuration. Thus, the chamber 438 prevents the contents of the container 400 from inadvertently being dispensed.

Various aspects of the subject matter described herein are set out in the following examples.

Example 1—A container for storing and dispensing a fluid agent is disclosed. The container comprises a flexible body portion defining an internal cavity, wherein the internal cavity is configured to store the fluid agent therein, and wherein an opening is defined in the body portion. The container further comprises a duckbill valve coupled to the opening of the body portion, wherein the duckbill valve is configurable between an open configuration and a closed configuration. The duckbill valve prevents the flow of the fluid agent out of the internal cavity when the duckbill valve is in the closed configuration, and the duckbill valve permits the flow of the fluid agent out of the internal cavity when the duckbill valve is in the open configuration. The container further comprises a cap, wherein the duckbill valve is prevented from being motivated into the open configuration when the cap is coupled to the body portion.

Example 2—The container of Example 1, wherein the duckbill valve is motivated into the open configuration when a force is applied to the body portion.

Example 3—The container of any one of Examples 1 and 2, wherein the cap comprises an interior wall defining a chamber, and wherein the chamber is sized to closely surround the duckbill valve.

Example 4—The container of Example 3, wherein the interior wall does not contact the duckbill valve.

Example 5—The container of any one of Examples 3 and 4, wherein the chamber comprises a cylindrical geometry.

Example 6—The container of any one of Examples 3-5, wherein the chamber is defined by tapered walls.

Example 7—The container of any one of Examples 3-6, wherein the chamber comprises a geometry configured to mimic a geometry of the duckbill valve.

Example 8—The container of any one of Examples 1-7, wherein the fluid agent is a cosmetic product.

Example 9—The container of any one of Examples 1-8, wherein substantially no fluid agent is dispensed out of the duckbill valve when the cap is coupled to the body portion.

Example 10—The container of any one of Examples 1-9, wherein the fluid agent is prevented from flowing out of the duckbill valve when the cap is coupled to the body portion.

Example 11—The container of any one of Examples 1-10, wherein the cap comprises cap threads, wherein the body portion comprises body threads, and wherein the cap threads are configured to engage the body threads when the cap is coupled to the body portion.

Example 12—The container of any one of Examples 1-11, wherein the cap comprises an exterior wall, and wherein the exterior wall is press-fit onto the body portion to secure the cap thereto.

Example 13—The container of any one of Examples 1-12, wherein the duckbill valve is closely received within the opening of the body portion.

Example 14—The container of any one of Examples 1-13, wherein the duckbill valve is replaceably positioned within the opening of the body portion.

Example 15—A packaging assembly is disclosed. The packaging assembly comprises a bottle defining an internal reservoir and a cap. A viscous agent is configured to be stored in the internal reservoir, and an opening is defined in the bottle to dispense the viscous agent therethrough. At least a portion of the bottle is pliable. The viscous agent is prevented from being dispensed out of the opening when the cap is coupled to the bottle.

Example 16—The packaging assembly of Example 15, wherein the packaging assembly further comprises a duckbill valve closely received by the opening of the bottle.

Example 17—The packaging assembly of Example 16, wherein the duckbill valve is configurable between an open configuration and a closed configuration. The duckbill valve prevents the flow of the viscous agent out of the internal reservoir when the duckbill valve is in the closed configuration, and the duckbill valve permits the flow of the viscous agent out of the internal reservoir when the duckbill valve is in the open configuration.

Example 18—The packaging assembly of Example 17, wherein the duckbill valve is prevented from being in the open configuration when the cap is coupled to the bottle.

Example 19—The packaging assembly of any one of Examples 15-18, wherein the viscous agent is a cosmetic product.

Example 20—The packaging assembly of any one of Examples 16-18, wherein the cap comprises an interior wall defining a chamber, and wherein the chamber is sized to closely surround the duckbill valve.

Example 21—The packaging assembly of Example 20, wherein the interior wall does not contact the duckbill valve.

Example 22—A container for storing and dispensing a fluid is disclosed. The container comprises a body portion defining an internal reservoir, wherein the internal reservoir is configured to store the fluid therein, wherein at least a portion of body portion is flexible, and wherein an opening is defined in the body portion. The container further comprises a duckbill valve coupled to body portion through the opening and a cap. The cap comprises an exterior wall and an interior wall. The interior wall defines a chamber configured to closely surround the duckbill valve when the cap is coupled to the body portion, and the fluid is prevented from dispensing out of the duckbill valve when the interior wall of the cap closely surrounds the duckbill valve.

While several forms have been illustrated and described, it is not the intention of the applicant to restrict or limit the scope of the appended claims to such detail. Numerous modifications, variations, changes, substitutions, combinations, and equivalents to those forms may be implemented and will occur to those skilled in the art without departing from the scope of the present disclosure. Moreover, the structure of each element associated with the described forms can be alternatively described as a means for providing the function performed by the element. Also, where materials are disclosed for certain components, other materials may be used. It is therefore to be understood that the foregoing description and the appended claims are intended to cover all such modifications, combinations, and variations as falling within the scope of the disclosed forms. The appended claims are intended to cover all such modifications, variations, changes, substitutions, modifications, and equivalents.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

What is claimed is:

1. A container for storing and dispensing a fluid agent, wherein the container comprises:

a flexible body portion defining an internal cavity, wherein the internal cavity is configured to store the fluid agent therein, and wherein the flexible body portion comprises an upper end that defines an opening in the body portion, wherein the upper end comprises a flat top surface surrounding the opening and a ledge defined on an interior surface of the flexible body portion;

a duckbill valve coupled to the ledge of the upper end of the body portion, wherein the duckbill valve is replaceably positioned within the upper end of the body portion, wherein the duckbill valve is configurable between an open configuration and a closed configuration, wherein the duckbill valve prevents flow of the fluid agent out of the internal cavity when the duckbill valve is in the closed configuration, and wherein the duckbill valve permits the flow of the fluid agent out of the internal cavity when the duckbill valve is in the open configuration; and a cap, wherein the duckbill valve is prevented from being motivated into the open configuration when the cap is coupled to the body portion, wherein the cap comprises an internal wall that forms a seal between the cap and the flat top surface of the upper end of the body portion by coupling the cap to the body portion, such that the internal wall of the cap forms a sealed chamber closely around the duckbill valve when the cap is coupled to the body portion, wherein the sealed chamber has a height dimension that is parallel to a longitudinal axis of the duckbill value, wherein the duckbill valve extends into the sealed chamber when the cap is coupled to the body portion by a length that is less than the height dimension of the sealed chamber such that a tip of the duckbill value does not contact the cap when the cap is coupled to the body portion.

2. The container of claim 1, wherein the duckbill valve is motivated into the open configuration when a force is applied to the body portion.

3. The container of claim 1, wherein the chamber comprises a cylindrical geometry.

4. The container of claim 1, wherein the chamber is defined by tapered walls.

5. The container of claim 1, wherein the chamber comprises a geometry configured to mimic a geometry of the duckbill valve.

6. The container of claim 1, wherein the fluid agent is a cosmetic product.

7. The container of claim 1, wherein substantially no fluid agent is dispensed out of the duckbill valve when the cap is coupled to the body portion.

8. The container of claim 1, wherein the fluid agent is prevented from flowing out of the duckbill valve when the cap is coupled to the body portion.

9. The container of claim 1, wherein the cap comprises cap threads, wherein the body portion comprises body threads, and wherein the cap threads are configured to engage the body threads when the cap is coupled to the body portion.

10. The container of claim 1, wherein the cap comprises an exterior wall, and wherein the exterior wall is press-fit onto the body portion to secure the cap thereto.

11. A packaging assembly, comprising:

a bottle defining an internal reservoir, wherein a viscous agent is configured to be stored in the internal reservoir, wherein at least a portion of the bottle is pliable, and the bottle comprises an upper end that defines an opening in the bottle to dispense the viscous agent therethrough, wherein the upper end comprises a flat top surface surrounding the opening and a ledge defined on an interior surface of the bottle;

a replaceable duckbill valve coupled to the ledge of the upper end of the bottle; and a cap, wherein the viscous agent is prevented from being dispensed out of the replaceable duckbill valve when the cap is coupled to the bottle, wherein the cap comprises an internal wall that forms a seal between the cap and the flat top surface of the upper end of the bottle by coupling the cap to the bottle, such that the internal wall of the cap forms a sealed chamber closely around the duckbill valve when the cap is coupled to the bottle, wherein the sealed chamber has a height dimension that is parallel to a longitudinal axis of the duckbill value, wherein the duckbill valve extends into the sealed chamber when the cap is coupled to the bottle by a length that is less than the height dimension of the sealed chamber such that a tip of the duckbill value does not contact the cap when the cap is coupled to the bottle.

12. The packaging assembly of claim 11, wherein the duckbill valve is configurable between an open configuration and a closed configuration, wherein the duckbill valve prevents flow of the viscous agent out of the internal reservoir when the duckbill valve is in the closed configuration, and wherein the duckbill valve permits the flow of the viscous agent out of the internal reservoir when the duckbill valve is in the open configuration.

13. The packaging assembly of claim 12, wherein the duckbill valve is prevented from being in the open configuration when the cap is coupled to the bottle.

14. A container for storing and dispensing a fluid, wherein the container comprises:

a body portion defining an internal reservoir, wherein the internal reservoir is configured to store the fluid therein, wherein at least a portion of body portion 1*s* flexible, and wherein the body portion comprises an upper end that defines an opening is defined in the body portion, wherein the upper end comprises a flat top surface surrounding the opening and a ledge defined on an interior surface of the body portion;

a replaceable duckbill valve coupled to the ledge of the upper end of the body portion such that the duckbill valve extends through the opening; and a cap, comprising:

an exterior wall; and an interior wall, wherein the interior wall defines a sealed chamber configured to closely surround the replaceable duckbill valve when the cap is coupled to the body portion, wherein a seal is formed between a base of the interior wall of the cap and the flat top surface of the body portion by coupling the cap to the body portion, wherein the sealed chamber has a height dimension that is parallel to a longitudinal axis of the duckbill valve, wherein the duckbill valve extends into the sealed chamber when the cap is coupled to the body portion by a length that is less than the height dimension of the sealed chamber such that a tip of the duckbill value does not contact the replaceable duckbill valve when the cap is coupled to the body portion, and wherein the fluid is prevented from dispensing out of the replaceable duckbill valve when the interior wall of the cap closely surrounds the replaceable duckbill valve.

* * * * *